United States Patent [19]

Morgan

[11] Patent Number: 4,602,802

[45] Date of Patent: Jul. 29, 1986

[54] SAILBOARD DOLLY

[76] Inventor: Robert D. Morgan, 572 Baker Pass Rd., Montecito, Calif. 93108

[21] Appl. No.: 661,704

[22] Filed: Oct. 17, 1984

[51] Int. Cl.[4] ..... B62B 1/26

[52] U.S. Cl. ..... 280/47.13 B; 114/344

[58] Field of Search ..... 280/47.13 B, 47.14; 114/344

[56] References Cited

U.S. PATENT DOCUMENTS

| | | | |
|---|---|---|---|
| 1,109,520 | 9/1914 | Flower | 114/344 |
| 1,370,592 | 3/1921 | King | 114/344 |
| 1,779,887 | 10/1930 | Melanson | 114/344 |
| 2,494,110 | 1/1950 | Steller | 114/344 |
| 2,551,040 | 5/1951 | Newell | 280/47.13 B |
| 2,637,050 | 5/1953 | Oliver | 114/344 |
| 3,445,018 | 2/1967 | Reagan | 280/47.13 B |
| 3,857,128 | 12/1974 | Gilster | 280/47.32 |
| 4,049,283 | 9/1977 | Brookes et al. | 280/47.13 R |
| 4,235,450 | 11/1960 | Conover | 280/47.32 |
| 4,392,665 | 7/1983 | Miller et al. | 280/414.2 |

FOREIGN PATENT DOCUMENTS

| | | | |
|---|---|---|---|
| 2633149 | 1/1978 | Fed. Rep. of Germany B | 280/47.13 |
| 2523919 | 9/1983 | France | 280/47.13 B |

*Primary Examiner*—John J. Love
*Assistant Examiner*—Joseph G. McCarthy
*Attorney, Agent, or Firm*—Schwartz, Jeffery, Schwaab, Mack, Blumenthal & Evans

[57] ABSTRACT

The invention comprises a dolly for use with a sailboard. The dolly has a U-shaped portion with upright members to receive a board which has been twisted 90° to the horizontal. An elastic strap extends across the top of the U-shaped members to hold the board in place. The dolly includes a pair of wheels which support the end of the board received in the U-shaped portion.

7 Claims, 4 Drawing Figures

SAILBOARD DOLLY

BACKGROUND OF THE INVENTION

1. Field of the Invention

The present invention relates to dollies and especially to a dolly adapted for carrying a sailboard.

2. Discussion of Related Art

In recent years the sport of sailboarding has become very popular. A sailboard comprises a board, similar to but larger than a surfboard, and a mast carrying a sail. The mast is movably attached to the board. The board, mast and associated equipment presents a rather bulky package which must be transported from a car to the beach in order to be used.

Conventionally, a sailboarder had to make several trips to the beach: one trip to carry the board, one trip to carry the sail and mast, and one trip for the rest of the gear. Accordingly, a need has arisen for a dolly which can enable a sailboarder to carry all of the necessary gear in a single trip.

Dollies have been suggested for various uses. However, no dollies are known which are especially adapted for use with a sailboard.

U.S. Pat. No. 4,235,450 to Conover discloses catamaran boat dollies. Each of the dollies has a generally U-shaped member which is mounted on a wheel. One dollie is attached to each of the pontoons of the catamaran and a tie down is connected across the top of each of the U-shaped frames.

U.S. Pat. No. 4,392,665 to Miller et al shows a boat dolly having a generally U-shaped frame.

U.S. Pat. Nos. 1,370,592 to King, 2,551,040 to Newell, 3,445,018 to Reagan, 3,857,128 to Gilster and 4,049,283 to Brookes et al show various types of dollies for carrying boats or other articles.

SUMMARY OF THE PRESENT INVENTION

One object of the present invention is to provide a dolly which is particularly designed for use with a sailboard to enable a person to carry all necessary sailboarding equipment at the same time.

Another object of the present invention is to provide a sailboard dolly which is light and maneuverable such that the dolly can be easily manipulated.

A further object of the present invention is to provide a sailboard dolly which is composed of relatively few components and is relatively easy to manufacture.

Yet another object of the present invention is to provide a sailboard dolly which is durable and efficient in use.

In accordance with the above and other objects, the present invention is a sailboard dolly which comprises a generally U-shaped frame to receive one end of a sailboard. Each side of the U-shaped frame extends downwardly to form an axle for receiving a wheel. Along the base of the U, a padded support bar is attached. The support bar has laterally and upwardly extending guide members which contact one side of the board.

BRIEF DESCRIPTION OF THE DRAWINGS

The above and other objects of the present invention will become more readily apparent as the invention becomes more clearly understood from the detailed description to follow, reference being had to the accompanying drawings in which like reference numerals represent like parts throughout, and wherein.

DETAILED DESCRIPTION OF THE PREFERRED EMBODIMENT

Figure 1:
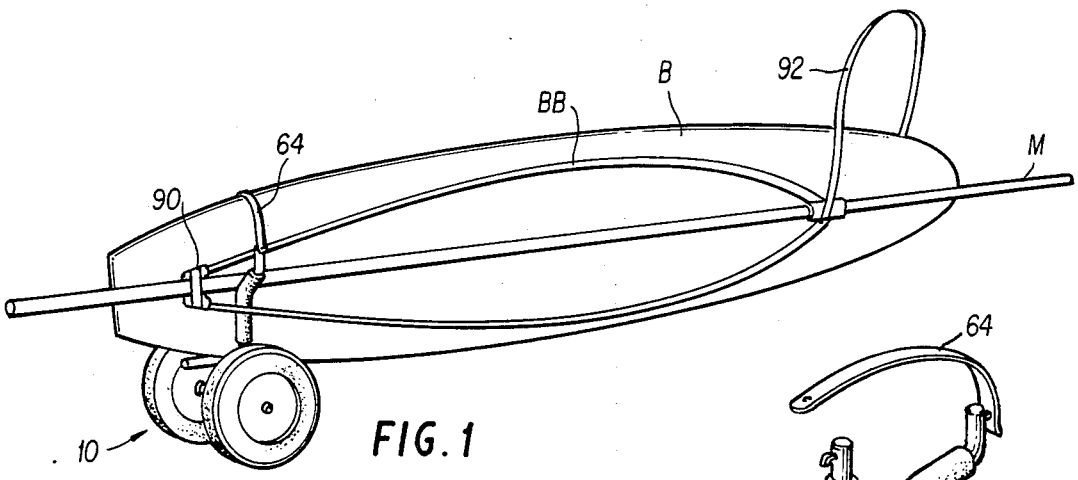
FIG. 1 is perspective view of the sailboard dolly i use.

With reference to FIGS. 1–4, it will be seen that th sailboard dolly 10 comprises a main frame 12, a suppoı bar 14, and a pair of wheels 16 and 18.

The main frame 12 has an overall height of approxi mately 21¼ inches and comprises a pair of side fram members 20 and 22 which are interconnected by a U shaped member 24 and by a crossbar 26. The distanc between the side frame members 20 and 22 are sepa rated by a distance of approximately 3¼ inches, which i only slightly greater than the depth of a board to b received therebetween. Each side frame 20, 22 i formed from a single length of 1-inch metal tubing stoc bent in the desired shape. Side frame 22 has bends at 2 and 30 to form two end portions 32 and 34 intercon nected by a central section 36. Section 32 is generall horizontal and forms a wheel axle. Section 34 is vertica and forms one side of a U-shaped framework for receiv ing the board. Sideframe 20 is bent at 38 and 40 to forr end portions 42 and 44 interconnected by section 4 End portion 42 forms an axle and portion 44 forms a upright member which is also part of the generall U-shaped frame for receiving the board. Portion 44 als has two bends in it at 48 and 50 to form outwardl extending portion 52 and upwardly extending portio 54. Portions 52 and 54 form an open mouth to aid i insertion of the board and also form a hook-like sectio to receive other parts of the sailboard apparatus.

One-inch washers 56 and 58 are welded or otherwis held in position on axles 32 and 34 to butt against th inside wheels mounted on the axles. U-shaped membe 24 is formed of one-inch by one-quarter inch flat stoc bent to a radius of approximately 1⅝ inches and i welded to side frame members 20 and 22. Cross membe 26 is ⅜ inch round stock which is welded to U-shape member 24 as well as to sideframe members 20 and 2

At the very top of side frame members 20, 22, dowr wardly turned hook elements 60, 62, respectively ar attached by welding or the like. Hook elements 60, 6 engage an elastic strap 64 which is stretched across th top of the board.

Figure 2:
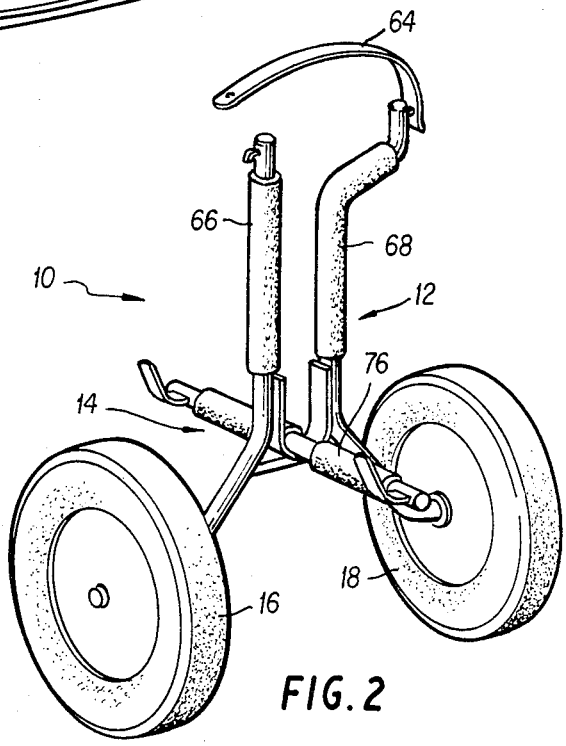
FIG. 2 is a perspective view of the sailboard dolly.
Figure 3:
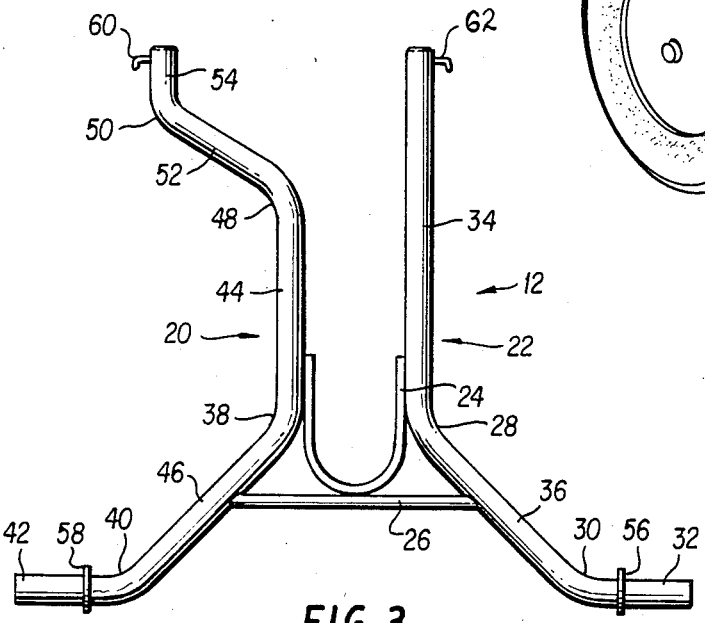
FIG. 3 is an elevational front view of the main fram of the sailboard dolly.

As shown in FIG. 2, sleeves 66, 68 are mounted o side frame members 20, 22 respectively. These sleeve may be made of any soft, resilient material, such as forı rubber or the like. The sleeves are slid on their respec tive sideframe members and abut against the top ends c U-shaped member 24.

Figure 4:
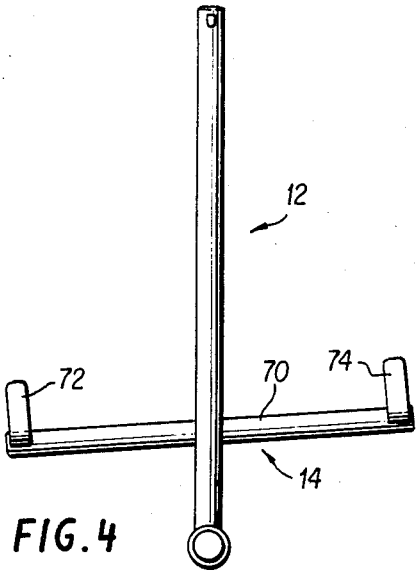
FIG. 4 is a side elevational view of the main fram and support bar of the sailboard dolly.

As shown in FIGS. 2 and 4, the lower support bar 1 is welded to the U-shaped member 24. The support ba 14 comprises one-inch tubing element 70 to the ends c which are attached outwardly and upwardly extendin members 72 and 74 which are formed from flat stoc bent with a 2-inch radius of curvature. Foam rubbe sleeves 76 and 78 are mounted on tubular member 70 c opposite sides of member 24, as shown FIG. 2.

With the main frame 12 held upright as shown i FIG. 4, tubular member 70 of support bar 14 forms a angle of approximately 5° with the horizontal.

In use, as shown in FIG. 1, the board B is twisted sideways by about 90° and placed into the main frame such that one side edge rests on sleeves 76 and 78. The rear end of the board is supported by dolly 10 and the dolly is positioned such that the support bar 14, which makes an angle of approximately 5° with the horizontal, is positioned on a similarly angled edge of the board. The boom BB is positioned such that one of its rails is received in the open upper end of the mainframe 12 such that it rests between the board and member 52. The boom is then permitted to hang from the main frame. The mast may either rest in the same area of the mainframe or may be tied to the boom as shown at 90. The opposite end of the boom and the mast are tied together and are also tied to a strap 92 which extends around the board. The other elements of the sailboard, such as the rigging and the centerboard may be attached at any convenient location either to the board itself or to the mainframe 12. With all of the elements of the sailboard in place, the front of the board may picked up by strap 92 and pulled to the location where it is to be assembled.

It should be understood that support member 14 extends along an edge of board B and members 72 and 74 rest against a major surface of the board. Strap 64 holds the dolly 10 firmly in place so that it will travel when the board is pulled. When the board is turned left or right, members 72 and 74 ensure that the dolly turns also by being forced against a surface of the board on which they rest.

The foregoing description is set forth for the purpose of illustrating the present invention but is not deemed to limit the scope thereof. Clearly, numerous additions, substitutions and other modifications may be made without departing from the scope of the invention, as set forth in the appended claims.

What is claimed is:

1. A dolly for use in transporting a sailboard, comprising:

a main frame having a single generally upright U-shaped portion and a pair of axles extending laterally from said U-shaped portion;

a pair of wheels rotatably mounted, respectively, on said axles;

an enlongated support member attached to said U-shaped portion for supporting an edge of a board received in said U-shaped portion, said U-shaped portion having a top portion and a bottom portion, said top portion extending outwardly to form a hook portion having an open top for receiving and holding implements associated with a sailboard; and means for connecting upper ends of said U-shaped portion for holding a board in said U-shaped portion;

wherein said support member extends on opposite sides of said U-shaped portion and has upwardly extending members connected on opposite sides of said U-shaped portion for contacting an upwardly extending surface of a board received in said U-shaped portion to aid in turning said dolly when said board is turned, said upwardly extending members being formed of a stiff material and being disposed to form a cradle with one side of said U-shaed portion such that an edge of a board received in said frame is held between said upwardly extending members and said one side of said U-shaped portion.

2. A dolly for use in transporting a sailboard, comprising:

a main frame having a single generally upright U-shaped portion and a pair of axles extending laterally from said U-shaped portion;

a pair of wheels rotatably mounted, respectively, on said axles;

an elongated support member attached to said U-shaped portion for supporting an edge of a board received in said U-shaped portion; and means for connecting upper ends of said U-shaped portion for holding a board in said U-shaped portion;

wherein said support member extends on opposite sides of said U-shaped portion and has upwardly extending members connected on opposite sides of said U-shaped portion for contacting an upwardly extending surface of a board received in said U-shaped portion to aid in turning said dolly when said board is turned, said upwardly extending members being formed of a stiff material and being disposed to form a cradle with one side of said U-shaped portion such that an edge of a board received in said frame is held between said upwardly extending members and said one side of said U-shaped portion.

3. A dolly as set forth in claim 1 wherein said U-shaped portion has a width which is only slightly wider than the depth of a board to be received therein.

4. A dolly as set forth in claim 1 wherein said mainframe comprises a pair of sideframe members which are bent to form said axles and a U-shaped member connected between said sideframe members.

5. A dolly as set forth in claim 1 including padding on sides of said U-shaped portion and on said support member.

6. A dolly as set forth in claim 1 including a strap for connection to a forward portion of a sailboard for holding said forward portion up while manipulating said sailboard.

7. A dolly as set forth in claim 1 wherein sides of said U-shaped portion are separated by a distance only slightly greater than the depth of a board to be received therebetween.

* * * * *